US007296638B2

(12) United States Patent
Beach et al.

(10) Patent No.: US 7,296,638 B2
(45) Date of Patent: Nov. 20, 2007

(54) ORIENTATION DEVICE FOR A CORE SAMPLE

(75) Inventors: Andrew Beach, Canningvale (AU); Gavin McLeod, Ardross (AU)

(73) Assignee: 2IC Australia Pty. Ltd., Canningvale, Wa (AU)

( * ) Notice: Subject to any disclaimer, the term of this patent is extended or adjusted under 35 U.S.C. 154(b) by 223 days.

(21) Appl. No.: 10/493,305

(22) PCT Filed: Nov. 1, 2002

(86) PCT No.: PCT/AU02/01496

§ 371 (c)(1),
(2), (4) Date: Oct. 5, 2004

(87) PCT Pub. No.: WO03/038232

PCT Pub. Date: May 8, 2003

(65) Prior Publication Data

US 2005/0034894 A1 Feb. 17, 2005

(30) Foreign Application Priority Data

Nov. 2, 2001 (AU) ..... PR8670
Feb. 1, 2002 (AU) ..... PS0306

(51) Int. Cl.
*E21B 25/16* (2006.01)
*E21B 10/02* (2006.01)

(52) U.S. Cl. ..... 175/44; 175/244; 175/245; 175/249

(58) Field of Classification Search ..... 175/44, 175/240, 239, 251, 246, 245, 249, 248, 333, 175/332, 387, 404, 403, 244
See application file for complete search history.

(56) References Cited

U.S. PATENT DOCUMENTS 1,773,915 A 8/1930 Lydon
2,652,232 A 9/1953 Holland
3,115,196 A * 12/1963 Roxstrom ..... 175/44
5,957,221 A * 9/1999 Hay et al. ..... 175/44

FOREIGN PATENT DOCUMENTS

GB 2251307 A 7/1992
WO WO 00/75480 A1 12/2000

OTHER PUBLICATIONS

Derwent Abstract Accession No. 87-071406/10, SU 1244283 A (Sevukrgeogiya) Jul. 15, 1986.

* cited by examiner

*Primary Examiner*—William Nouder
*Assistant Examiner*—Brad Harcourt
(74) *Attorney, Agent, or Firm*—Edell, Shapiro & Finnan, LLC

(57) ABSTRACT

Core orientator for a core drill includes a face orientator and a bottom orientator supported by a shaft which extends into a shroud. A tubular extension is coupled to the shroud and is slidably coupled to a main body. The main body includes first and second latches. The first latches releasably lock the device to a core lifter case assembly disposed within the core drill, to selectively prevent the device from advancing in an uphole direction within the core drill. The latching system operates to prevent the device from falling out of the core drill. Face orientator includes a plurality of pins which can move axially to provide a plurality of profile reference points to a facing surface of a hole to be drilled. The bottom orientator includes a plurality of balls disposed within respective braces.

29 Claims, 9 Drawing Sheets

ORIENTATION DEVICE FOR A CORE SAMPLE

FIELD OF THE INVENTION

The present invention relates to an orientating device for providing an indication of the orientation of a ground core sample cut by a core drill.

BACKGROUND OF THE INVENTION

Core sampling is typically employed to allow geological surveying of the ground for purposes of exploration and/or mine development. Analysis of the material within the core sample provides information of the composition of the ground. However in order to map, for example a vein of ore, it is necessary to also have knowledge of the orientation of the core sample relative to the ground from which it was cut.

Several systems are already known for orientating core samples. One such system is the BALLMARK (Trademark) system which is described in International Application No. WO 00/75480. This system utilises a soft metal disk and a free running metal ball which are incorporated into a conventional inner tube back end or head assembly. The system utilises the force generated during breaking a core from the parent rock strata to indent the soft metal disk with the metal ball. As the ball is free running, gravity causes it to be positioned at the lowest point in its track, which corresponds with the bottom side of the hole and consequently the bottom of the core.

The BALLMARK system has achieved high market acceptance and provides relatively high core orientation accuracy. Nevertheless, one drawback of the BALLMARK system is that it only operates by the actual breaking of the core. Core breaking involves lifting a drill string into which the core has advanced and applying sufficient tensile force to break the core from the bottom of the hole being drilled by the drill. However, in highly fractured or broken ground, the core breaks by itself during the drilling process. In this instance, the BALLMARK system will not operate.

A more rudimentary system for core marking involves running a marking tool, which in essence is in the form of a red pencil on the end of a counter balanced spear, by a wireline down the drill string to physically mark the core. A substantial drawback with this system is that it requires separate tripping of the tool down the hole which takes substantial time thereby reducing actual drilling time and substantially increasing the cost of coring.

Another marking system is the VAN RUTH wireline core orientator which utilises a plurality of slidable pins to provide a contour of the face of the core. Yet another system described in U.S. Pat. No. 4,311,201 relies on the use of a malleable material to provide an imprint of the face of the core. However, again both these systems require the separate tripping of a tool in order to provide orientation of the core.

SUMMARY OF THE INVENTION

It is an object of the present invention to provide an orientation device for a core sample which does not require core breaking for operation and can be incorporated into a standard core drill so that it does not require separate tripping.

According to the present invention there is provided an orientation device for providing an indication of the orientation of a core sample of material relative to a body of material from which the core is cut, said orientation device including at least:

a main body provided with a latching system for releasably latching the orientation device to a core lifter case assembly coupled to a core tube of a core drill used to cut said core sample; and, a core orientation indicating means slidably coupled to said main body for providing an orientation reference for said core sample by action of contacting a facing surface of said material to be drilled by said core drill prior to commencement of drilling, said core orientation indicating means operatively associated with said latching system whereby upon sliding of said core orientation indicating means toward said main body beyond a trigger point facilitated by advancing of said core drill onto said facing surface said core orientation indicating means disengages said latching system from said core lifter case assembly so that said orientation device is retracted into said core tube by an advancing core when said drill is operated to cut said core.

Preferably said latching system includes first latching means for engaging said core lifter case assembly to prevent said main body from moving in an uphole direction prior to core orientation indicating means reaching said trigger point.

Preferably said latching system includes second latching means for engaging said core tube to prevent motion of said main body in a downhole direction.

Preferably said second latching means includes a brake mechanism supported by said main body and having a plurality of brake elements which, when said main body is moved in a downhole direction relative to said core tube, wedge between said main body and an inner surface of said core tube with increasing force to brake said relative motion and effectively releasably lock said main body to said core tube, and when said main body is moved in an uphole direction relative to said core tube, self release from said inside surface of said core tube.

Preferably said braking mechanism includes a braking surface formed about said main body, said braking surface provided with progressively increasing outer diameter in an uphole direction; and, bias means for biasing said brake elements in said uphole direction along said braking surface.

Preferably said braking mechanism further includes retaining means for retaining said braking elements about said main body.

Preferably each of said braking elements is in the form of a ball.

Preferably said core orientation indicating means includes a face orientator having one or more orientation elements for providing said orientation reference and, a shroud into which said one or more orientation elements retract as said core drill is advanced onto a said facing surface.

Preferably said orientation device includes a tubular extension coupled to said shroud and extending into and slidably retained by said main body, said extension provided with a latching surface wherein said first latching means is held in engagement with said core lifter case assembly by abutment of said first latching means with said latching surface, whereby in use, as said core drill is advanced onto said facing surface, said shroud contacts said bottom and slides toward said main body moving said latching surface out of abutment with said first latching means thereby disengaging said first latching means from said core lifter case assembly whereby said orientation device can retract into said core tube.

Preferably said core orientation indicating means includes a shaft passing through said tubular extension and housing into said shroud and having a downhole end at which said one or more orientation elements are supported.

Preferably said orientation device further includes first bias means for biasing said tubular extension in a downhole direction and said latching surface into abutment with said first latching means.

Preferably said orientation device further includes: detent means for releasably axially locking said shaft to said tubular extension; and, second bias means acting between said shaft and said tubular extension for biasing said shaft to move axially in an uphole direction relative to said tubular extension when said detent means is released.

Preferably said detent means acts between said main body and said tubular extension and is released as said core orientation indicating means slides toward said main body prior to reaching said trigger point.

Preferably said shroud and said one or more orientation elements are relatively dimensioned so that when said detent means is released said shaft moves axially in an uphole direction by a distance sufficient so that said orientation elements are wholly located within said shroud.

Preferably said core orientation indicating means includes a bottom orientator having a plurality of orientation balls and a plurality of races about which individual orientation balls can run, each race formed by two opposing race surfaces which are adapted to move relative to each other between a free run position where said race surfaces are spaced sufficiently apart to allow an orientation ball therebetween to run freely, and a clamp position wherein two adjacent race surfaces clamp an orientation ball therebetween to prevent said orientation ball from free running about said race.

Preferably said race surfaces are moved between said free run position and said clamp position by said second bias means upon release of said detent means.

Preferably one or more of said race surfaces are formed of a material which is sufficiently soft so that when said race surfaces are in said clamp position an orientation ball therebetween indents said race surfaces.

Preferably said races include at least one annular disc slidably mounted on said shaft.

Preferably said bottom orientation includes three orientation balls and said races include two annular discs slidably mounted on said shaft and respective uphole and downhole end race surfaces supported on said shaft between which said annular discs are located, wherein said downhole end race surface is fixed to a downhole side of said shaft and said uphole end race surface is slidably mounted on said shaft.

Preferably said orientation device further includes an inclinometer disposed within said main body for providing an indication of inclination of said orientation device when said core orientation indicating means is in contact with said facing surface.

Preferably said inclinometer is in the form of a rotatable wheel and, said shaft is moved toward said wheel to prevent rotation thereof when said detent means is released.

Preferably said wheel is mounted to rotate about first and second mutually perpendicular axes.

Preferably said wheel is provided with a pair of ball bearings on opposite sides of an axis of said wheel and said inclinometer further includes a circular race within which said ball bearings can run, said circular race having an axis coincident with a longitudinal axis of said main body.

In an alternate embodiment said shaft is rotatably held within said tubular extension whereby said shaft can rotate about its longitudinal axis relative to said shroud.

In this embodiment said orientation device includes a deadweight disposed in said main body and coupled to said shaft to rotate said shaft about its longitudinal axis by action of gravity to provide a bottom of hole reference. As bottom orientation is achieved by the combination of rotatably mounting the shaft and the provision of the deadweight, this embodiment provides an alternate to the use of the ball and race type bottom orientation.

According to a further aspect of the present invention there is provided a brake system for a tool travelling within a tubular element having an inner circumferential surface, said brake system including:

a plurality of brake elements;

a braking surface formed on said tool, said braking surface having an outer diameter which progressively increases in a first direction; and, first bias means for urging said brake elements in said first direction, said braking surface and said brake elements relatively dimensioned so that said brake elements can be wedged between said braking surface and said inner circumferential surface to lock said tool to said tubular element in response to a force applied to said tool in a second direction opposite to said first direction, and to brake or retort the motion of said tool within said tubular element in response to a force applied against the tool in said first direction.

Preferably said brake system further includes an automatically releasable brake lock having a first position where said lock holds said brake elements on a portion of said braking surface against the bias of said first bias means where said brake elements cannot engage said inner circumferential surface, and a second position releasing said brake elements to move under the influence of said first bias means along said braking surface in said first direction.

BRIEF DESCRIPTION OF THE DRAWINGS

An embodiment of the present invention will now be described by way of example only with reference to the accompanying drawings in which.

DETAILED DESCRIPTION OF PREFERRED EMBODIMENTS

Figure 1:
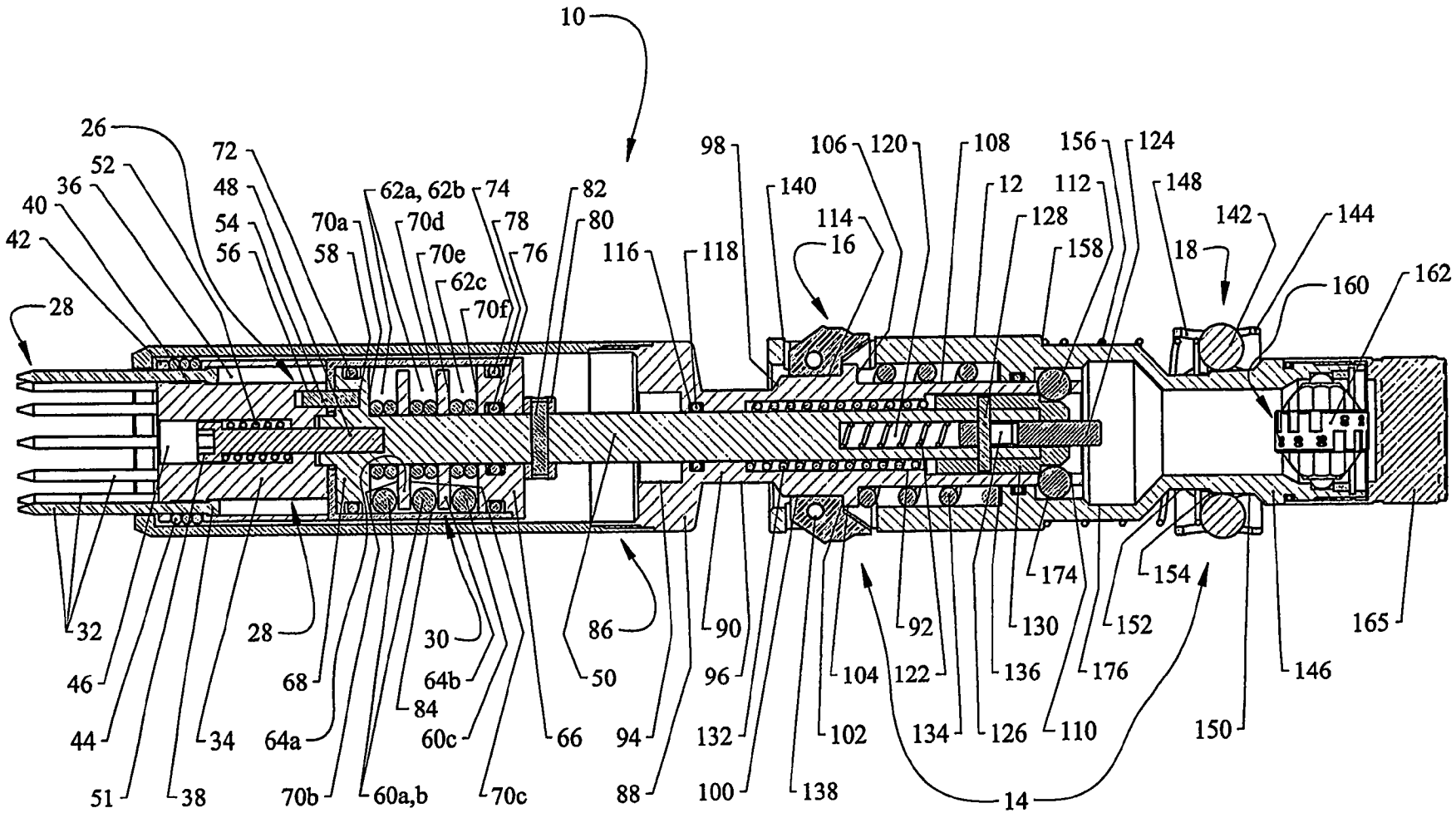
FIG. 1 is a section view of an embodiment of the orientation device.

Referring to FIGS. 1-6 of the accompanying drawings, an embodiment of the orientation device 10 in accordance with the present invention includes a main body 12 provided with a latching system 14 which includes first latches 16 and second latches 18. (As described in greater detail hereinafter, the second latches 18 are in the form of a braking system). The latching system 14 operates to releasably latch the device 10 to a core lifter case assembly 20 (see FIG. 3) which incorporates a core lifter coupled to a core tube 22 of a core drill 24 used for cutting a core sample of the ground. The core lifter case assembly 20, core tube 22, and core drill 24 are of conventional construction and do not of themselves form part of the present invention.

A core orientation indicating means (hereinafter referred to as "core orientator") 26 is slidably coupled to the main body 12. The core orientator 26 provides an orientation reference for the core sample cut by the core drill 24 by action of the core orientator 26 contacting the toe (i.e. bottom facing surface) of the hole being drilled prior to the commencement of drilling, i.e. the rotation of the core drill 24. The core orientator 26 is associated with the latching system 14 so that upon sliding of the core orientator relative to the main body 12 beyond a trigger point, the core orientation 26 disengages the latching system 14 from the core lifter case assembly 20 so that the orientation device 10 is retracted into the core tube 22 by an advancing core which is cut after commencement of drilling.

The orientation device 26 includes two main components, a VAN RUTH style face orientator 28 which provides a plurality of reference points conforming with an end face of the core sample being cut and, a bottom orientator 30 which provides a reference line corresponding to the bottom of the hole cut by the core drill 24.

The face orientator 28 includes a plurality of circumferentially arranged orientation elements in the form of pins 32 which are retained and can slide in respective holes 36 formed in a core block 34. Each of the pins 32 is formed with an enlarged head 38 which is dimensioned so that it can not pass out from a lower end of a corresponding hole 36. The core block 34 is further provided with a circumferential cut-out 40 inboard of a downhole end 42 of a core block 34. A plurality of rubber O-rings 44 is seated in the cut-out 40 about the pins 32 and act as a brake holding the pins 32 in position in the absence of a force applied along the length of the pins 32. The core block 34 is further provided with an axial hole 46 which opens on to the downhole end 42. The hole 46 accommodates a screw 48 which couples the core block 34 to a shaft 50 of the device 10. Retained between a head 50 of the screw 48 and the toe of the hole 46 is a core block spring 52 which acts to bias the core block 34 toward the shaft 50. However, by virtue of this coupling, the core block 34 can be pulled against the bias of spring 52 to space it from the shaft 50. A locating pin 54 extends partially into holes 56 and 58 formed in the core block 34 and shaft 50 respectively to fix the rotational position of the core block 34 to the shaft 50.

The bottom orientator 30 includes a plurality (in this instance 3) balls 60*a*, 60*b* and 60*c* (hereinafter referred to in general as "balls 60") disposed within respective races 62*a*, 62*b*, and 62*c* respectively (hereinafter referred to in general as "races 62"). The races 62 comprise two annular discs 64*a* and 64*b* which are slidably mounted on the shaft 50, a cap 66 also slidably mounted on the shaft 50 on an uphole side of the discs 64, and an end stop 68 fixed to the shaft 50 on a downhole side of the discs 64. Race 62*a* is defined between a race surface 70*a* formed on the end stop 68 and adjacent face 70*b* of disc 64*a*. Race 62*b* is defined between a race surface 70*b* on an opposite side of the disc 62*a*, and facing race surface 70*c* on disc 62*b*; while the race 62*c* is defined between race surface 70*e* on an opposite side of the disc 64*b* and a facing race surface 70*f* on the cap 66. Bias means such as annular spacing rubbers 73 are disposed between the mutually facing race surfaces 70. (However, it is to be understood that the rubbers can be replaced with other bias means such as springs.)

O-ring seals 72 and 74 are located in corresponding circumferential grooves formed on an outer circumferential surface of the end stop 68 and cap 66 respectively. The cap 66 is also provided with a groove 76 formed about its inner circumferential surface for seating an O-ring 78 which bears against the outer surface of the shaft 50. A bush 80 is fixed to the shaft 50 on a side of the cap 66 opposite the end stop 68 by a bush pin 82. The races 62 and in particular, annular discs 64 and spacing rubbers 72, 73 are enclosed by a sleeve 84.

Figure 3:
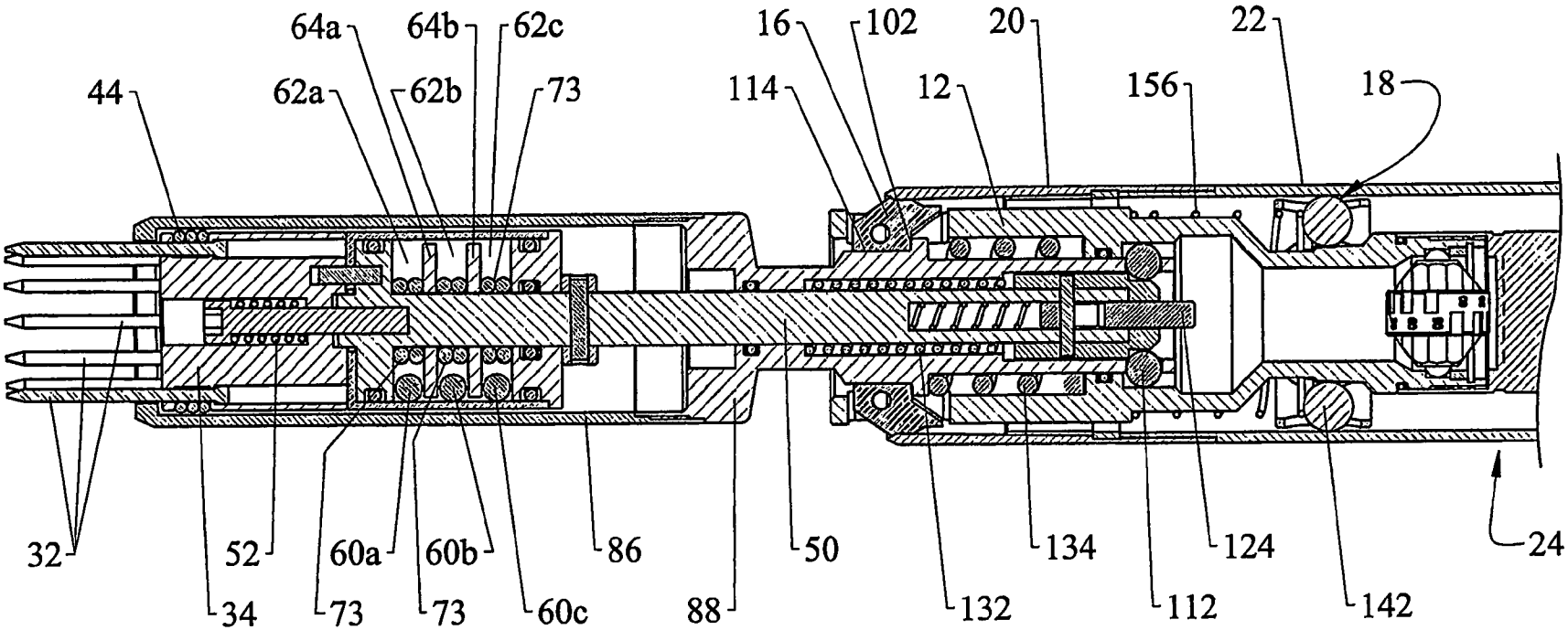
FIG. 3 is a section view of the orientation device shown within a drill pipe at a first stage of operation.

Due to the construction of the bottom orientator 30, it will be appreciated that the width of the races 62 and thus the distance between opposing race surfaces 70 can be changed. More particularly, the race surfaces can be moved between a free run position where the surfaces 70 are spaced sufficiently apart to allow the balls 60 disposed therebetween to freely run within the race 62 (as shown in FIGS. 1 and 3) and a clamp position where the ball 60 disposed between a pair of opposing race surfaces 70 is clamped by the surfaces thereby preventing it from rolling about the corresponding race 62 (shown in FIGS. 4 and 5).

The orientation device 26 further includes a shroud 86 within which the face orientator 28 and bottom orientator 30 are disposed, and can retract into when the core drill 24 is lowered onto the bottom of a hole.

The shroud 86 is slidably retained by the body 12 via a locking housing 88 to which the shroud 86 is threadingly coupled. The locking housing 88 includes a generally tubular extension 90 which extends into the main body 12. The extension 90 is provided with an axial hole 92 through which the shaft 50 extends. A recess 94 is formed on a side of the locking housing 88 enclosed by the shroud 86 for seating the bush 80. An outer surface of the extension 90 includes a first portion 96 at a downhole end of constant diameter followed by a contiguous and relatively short portion 98 of lineally increasing outer diameter leading to a further portion 100 of constant diameter which terminates in a radially outward step 102 followed by a short portion 104 of constant diameter then a radially inward step 106 leading to a final portion 108 of constant diameter. A plurality of holes 110 is formed in the portion 108 near, but inboard of a free end of the portion 108. The holes 110 seat respective trigger balls 112. The combination of the portion 100 and step 102 on the outer surface of the extension 90 form a latch seat 114 for the latches 16. A circumferential groove 116 is formed in the locking housing 88 for seating an O-ring 118 that bears against the outer surface of the shaft 50 passing through the hole 92.

An end of the shaft 50 which is disposed within the hole 92 is formed with a blind axial hole 120 in which is disposed an inclinometer lock spring 122. The spring 122 is held within the hole 120 by a inclinometer lock pin 124 that partially extends into the hole 120 and partially extends from the free end of the shaft 50. The inclinometer lock pin 124 is formed with an elongated hole or slot 126 through which a trigger seat pin 128 passes coupling the inclinometer lock pin 124 to the shaft 50. The trigger lock pin 128 further extends on opposite sides into a trigger ball seat 130 which is disposed over the free end of the shaft 50 and through which the inclinometer lock pin 124 extends.

A shaft spring 132 is disposed about the shaft 50 within the hole 92 and bears against the trigger ball seat 130. The spring 132 acts to bias the shaft 50 to move it in an uphole direction relative to the locking housing 88.

A locking spring 134 is located between the body 12 and portion 108 of the extension 90. The spring 134 bears at one end against the step 106 and at an opposite end against a radial surface 136 formed internally of the body 12. The spring 134 biases the locking housing 88 in a downhole direction relative to the body 12.

Figure 2:
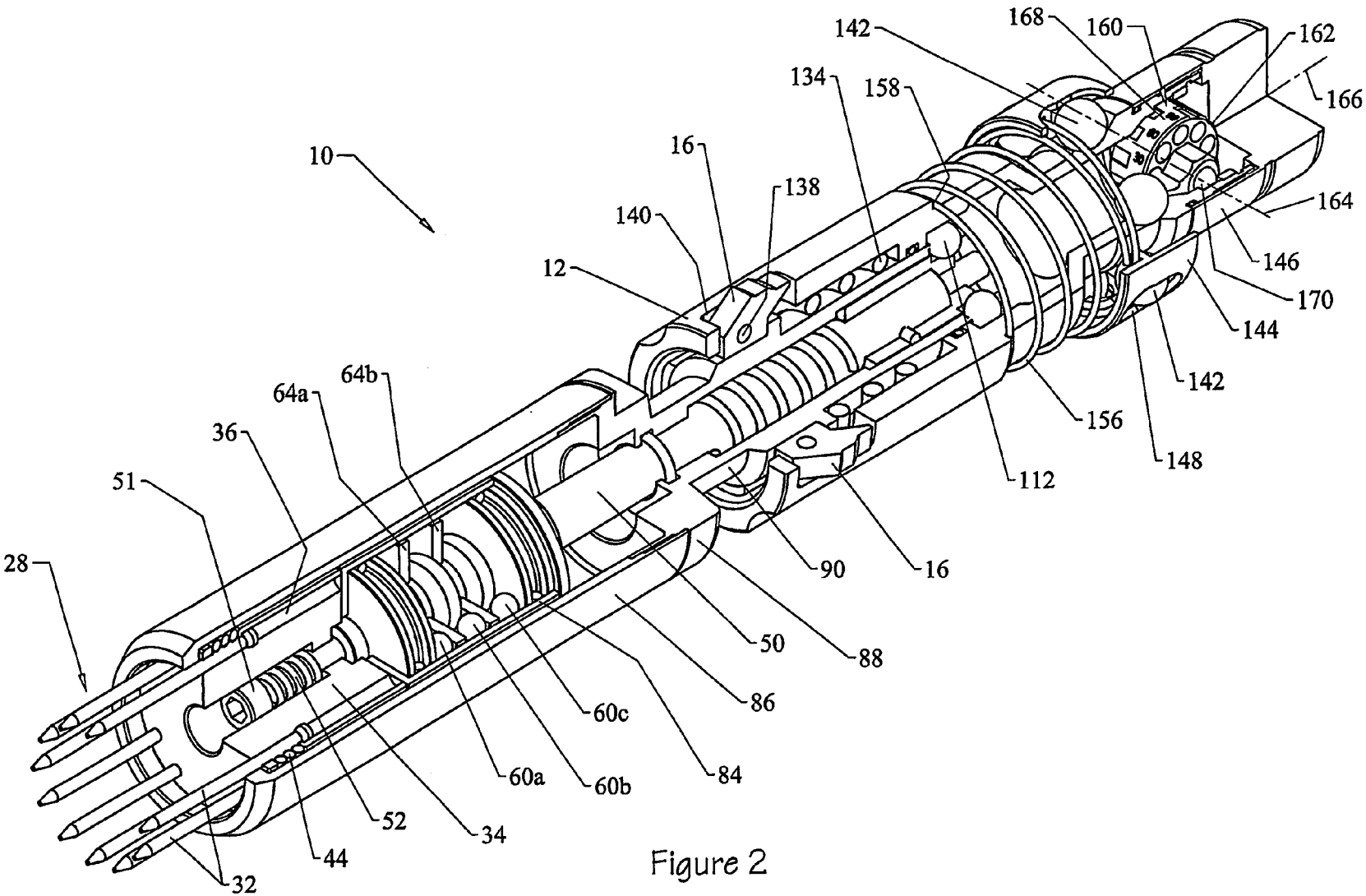
FIG. 2 is a partial cutaway perspective view of the orientation device shown in FIG. 1.

The latches 16 are pivotally mounted on pivot pins 138 to the main body 12 and extend through windows 140 formed in the body 12 (see FIG. 2).

The latch or brake system 18 includes a plurality of anchor balls 142 which are retained by a anchor ball sleeve 144 disposed about a tail section 146 of the main body 12. In this regard, the sleeve 144 is provided with a plurality of holes 148 of a diameter less than the diameter of the balls 142 through which the balls 142 can protrude but not fall out. The braking system further includes a braking surface 150 formed about the tail section 146. The braking surface 150 is formed with a gradually increasing outer diameter in a uphole direction, i.e. a direction away from the locking housing 88. A further surface 152 is formed about the tail section 146 adjacent the braking surface 50 but of a smaller outer diameter. The two surfaces 150 and 152 are joined by a short tapered surface 154. An anchor ball spring 156 is disposed about the tail section of the body 12 and has one end seated against a shoulder 158 formed in the body 12 and an opposite end disposed within-he sleeve 144 and bearing against the anchor balls 142. The spring 156 acts to bias the anchor balls 142 along the braking surface 150 in the uphole direction.

The anchor balls 142 and braking surface 150 are dimensioned so that the balls 142 can ride along the braking surface 150 to wedge against an inner surface of the core tube 22 to produce a braking effect. More particularly, when the device 10 is travelling in a downhole direction within the core drill 24 the trigger balls 142 lock the device 10 to the core tube 22 preventing it from moving in the downhole direction and in particular falling out of the end of the core drill 24. Further, by appropriate selection of the spring 156, the braking system 18 also provides a braking effect against motion of the tool in an opposite direction. The degree of braking effect is dependent on the spring constant of the spring 156. This braking effect is particularly useful when the device 10, or another tool to which a similar braking system is applied is used in an uphole configuration to reduce the speed of the device 10 or other tool when travelling back under the influence of gravity.

An inclinometer 160 provided in the tail section 146 of the body 12. The inclinometer 160 is in the form of a wheel 162 which is rotatably mounted about two mutually perpendicular axes 164 and 166. The wheel 162 provided on its outer circumferential surface with a scale 168 providing an indication of the degree of inclination of the device 10 relative to a horizontal plane. The wheel 162 is weighted so that when it lies in a horizontal plane, a 0° marking lies in the horizontal plane. The wheel 162 is mounted within a circular bearing race 170 formed internally of the tail section 146. Ball bearings 172 are coupled to the wheel 162 at opposite ends of the axis of the wheel 162 which coincides with the axis 164. In view of this mounting arrangement, it will be appreciated that the wheel 162 can rotate about the axis 164 and also rotate about the axis 166.

The inside surface of the body 12, in the tail section 146 is formed with a surface 174 of constant diameter against which the trigger balls 112 can bear. The surface 174 leads in an uphole direction to an increased inner diameter portion 176. The combination of the trigger balls 112, surface 174 and trigger ball seat 130 form a detent 133 (see FIG. 6).

Figure 4:
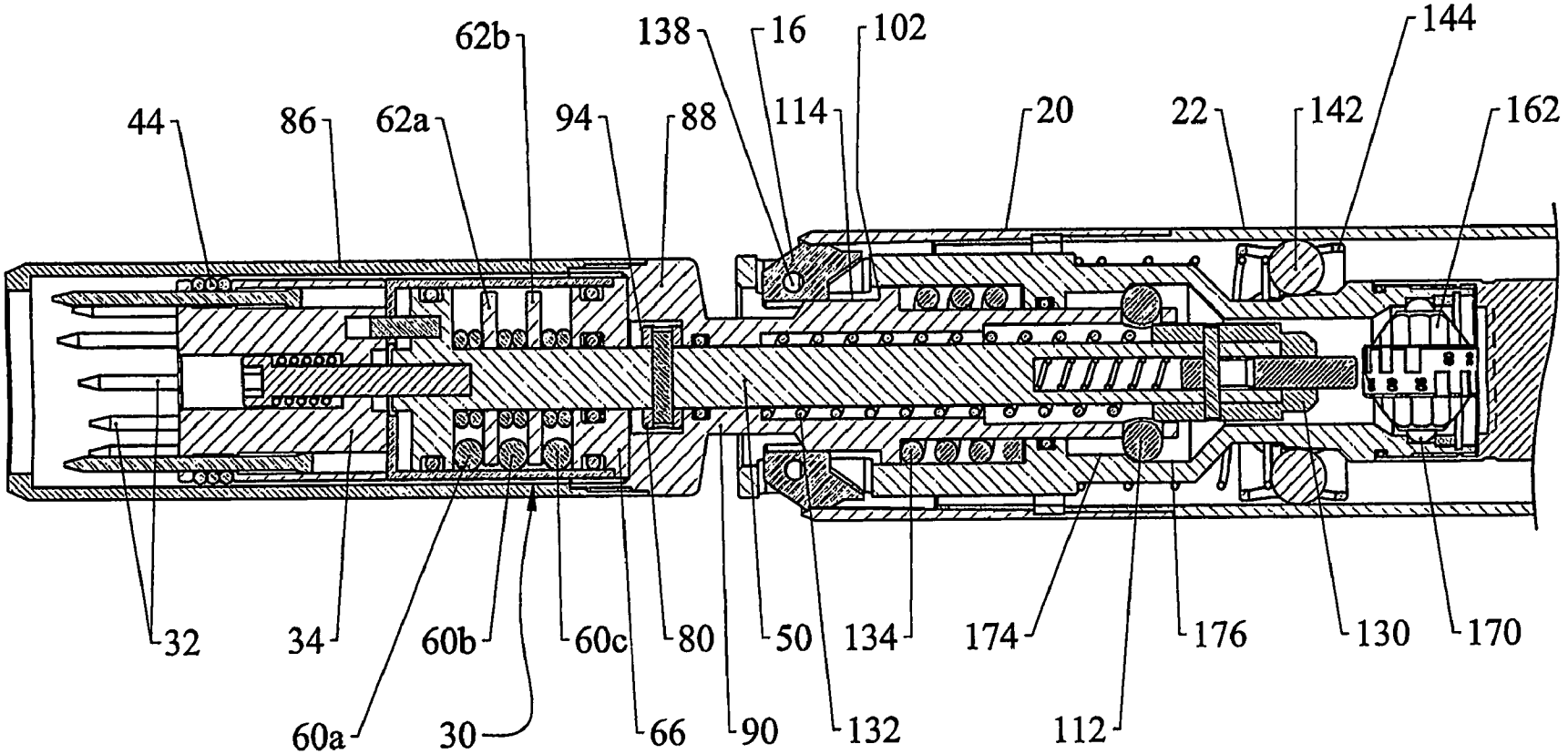
FIG. 4 is a section view of the orientation device shown within a drill pipe at a second stage of operation.

The operation of the device 10 will now be described in detail with particular reference to FIGS. 3-5.

The device 10 is initially manipulated so that the pins 32 are pulled to their maximum extent from the core block 34, the shroud 86 and locking housing pulled to their maximum extent from the body 12 and the shaft 50 pulled to its maximum extent from the shroud 86. In this configuration, the latches 16 are seated on the latch seats 114 and abut the step 102 and, the trigger balls 122 are held between the surface 174 and trigger ball seat 130. Thus the spring 132 is held in relative compression and the races 62 are in their free run position allowing the balls 60 to move about the respective races 62 under the influence of gravity.

The device 10 is then inserted into the core tube 22 from the end provided with the core lifter case assembly 20 with the tail section 146 first. This insertion is halted when the latches 16 engage the end of the core lifter case assembly 20 as depicted in FIG. 3. With the core drill 24 held in vertical or sub-vertical orientation, the device 10 is prevented from falling out of the core tube 22 (and thus core drill 24) by action of the braking system 18. In particular, the anchor balls 142 are effectively wedged between the inside surface of the core tube 22 and the braking surface 150 by the combined action of the spring 156 and the weight of the device 10.

The core tube 22 is then lowered into a core drill 24 in a conventional manner. Initially, the drill 24 is held above the toe of the hole a sufficient distance so that when the core tube 22 is properly located and seated within the core drill 24, the pins 32 are spaced from the toe of the hole. A drill operator then lowers the drill 24 onto the toe of the hole. It will be appreciated that as the races 62 are in their free run position, the balls 60 will roll by action of gravity to a location where they lie lowermost within the races.

As the drill is lowered on to the toe of the hole, the pins 32 contact the face or surface of the hole. This surface constitutes the upper surface of a core sample to be drilled with the core drill 24. The pins 32 slide into the holes 36 of the core block 34 against resistance of the O-rings 44 providing profile reference points conforming to the configuration of the face of the core sample. The pins 32 maintain their relative position by virtue of the frictional forces applied by the O-rings 44.

As the core drill 24 is progressively lowered into the hole, a front end of the shroud 86 eventually contacts the toe of the hole. Accordingly, the weight of the core drill 24 is now loaded onto the shroud 86. This causes the shroud 86 to move axially toward the body 12 with the extension 90 sliding into the body 12. This relative motion results in the latch seat 114 being progressively slid away from the latches 16, and the trigger balls 112 being rolled along the surface 174 and eventually into the increased diameter section 176, as depicted in FIG. 4.

When the trigger balls 112 reach the section 176 they are able to move radially outwardly moving out of the trigger ball seat 130. In consequence, the spring 132 forces the shaft 50 to slide axially into the body 12. This in turn forces the cap 66 against the locking housing 88 compressing the spacing rubbers 73 and squeezing the races 62 together to their clamp position where the orientation balls 60 are clamped against adjacent race surfaces 70. (The screw 48 and spring 52 allows the shaft 50 to retract further into the extension 90 by action of the spring 132 to place the race surfaces 70 in the clamp position). Accordingly, the position of the balls 60 when clamped provides an indication of the location of the lowest part of the hole from which a core sample being drilled by the core drill 24 is derived. Assuming perfect operation each of the three balls 60 will lie along a common straight line. However by providing three balls 60 a hitherto unattainable degree of confidence in alignment accuracy assurance is provided. If one of the races 62/balls 60 does not function correctly the remaining two balls will lie on a line indicative of the bottom of the hole. If all three balls are out of alignment then an operator can be very confident that the bottom of the hole orientation is unreliable and should be disregarded. In prior art one ball systems an operator is never completely sure that a bottom hole orientation indicated is accurate. Further, at this time, the inclinometer lock pin 124 advance toward and contact the wheel 162 preventing it from further rotation by outer axis 164 to provide an indication of the inclination of the device 10 at a point shortly prior to the commencement of cutting of the core.

Figure 5:
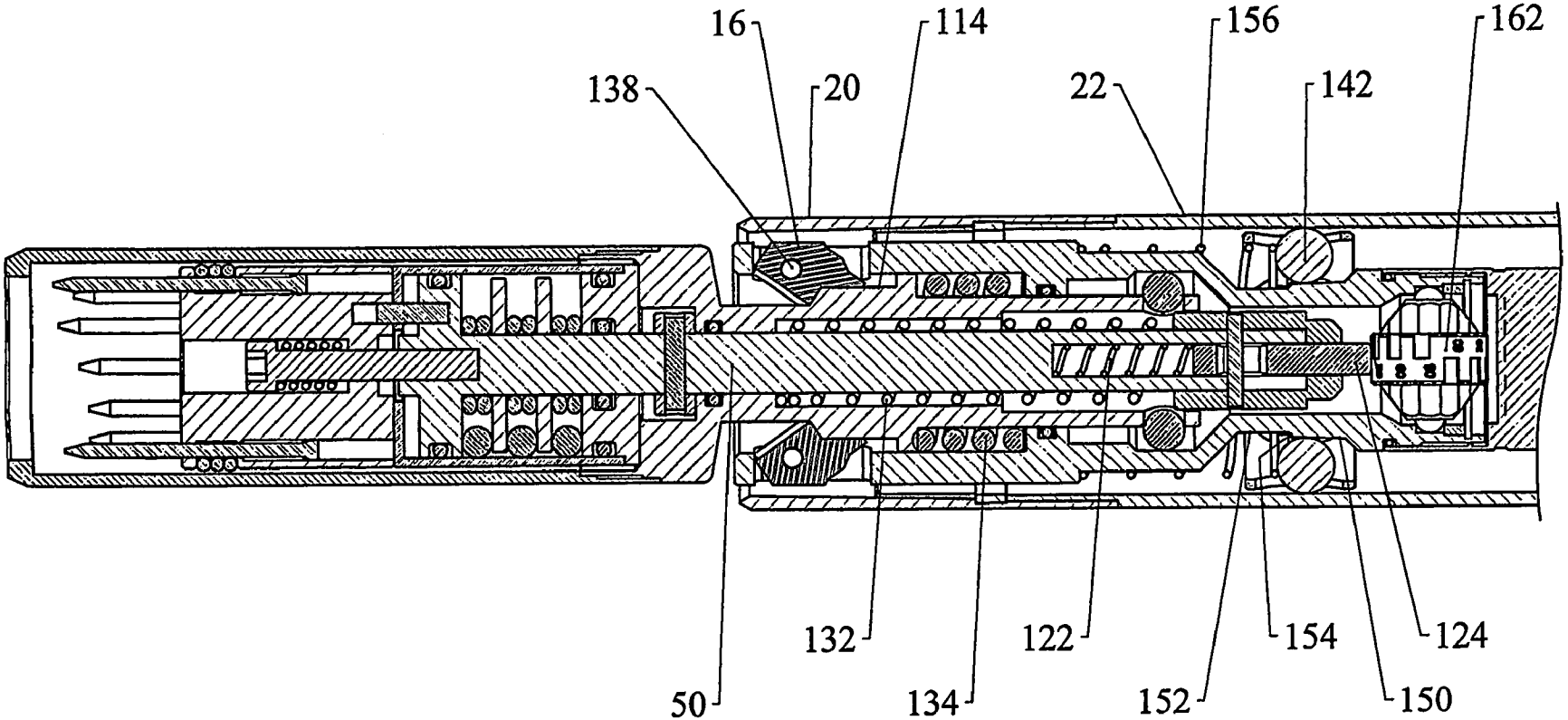
FIG. 5 is a section view of the orientation device shown within a drill pipe at a third stage of operation.
Figure 6:
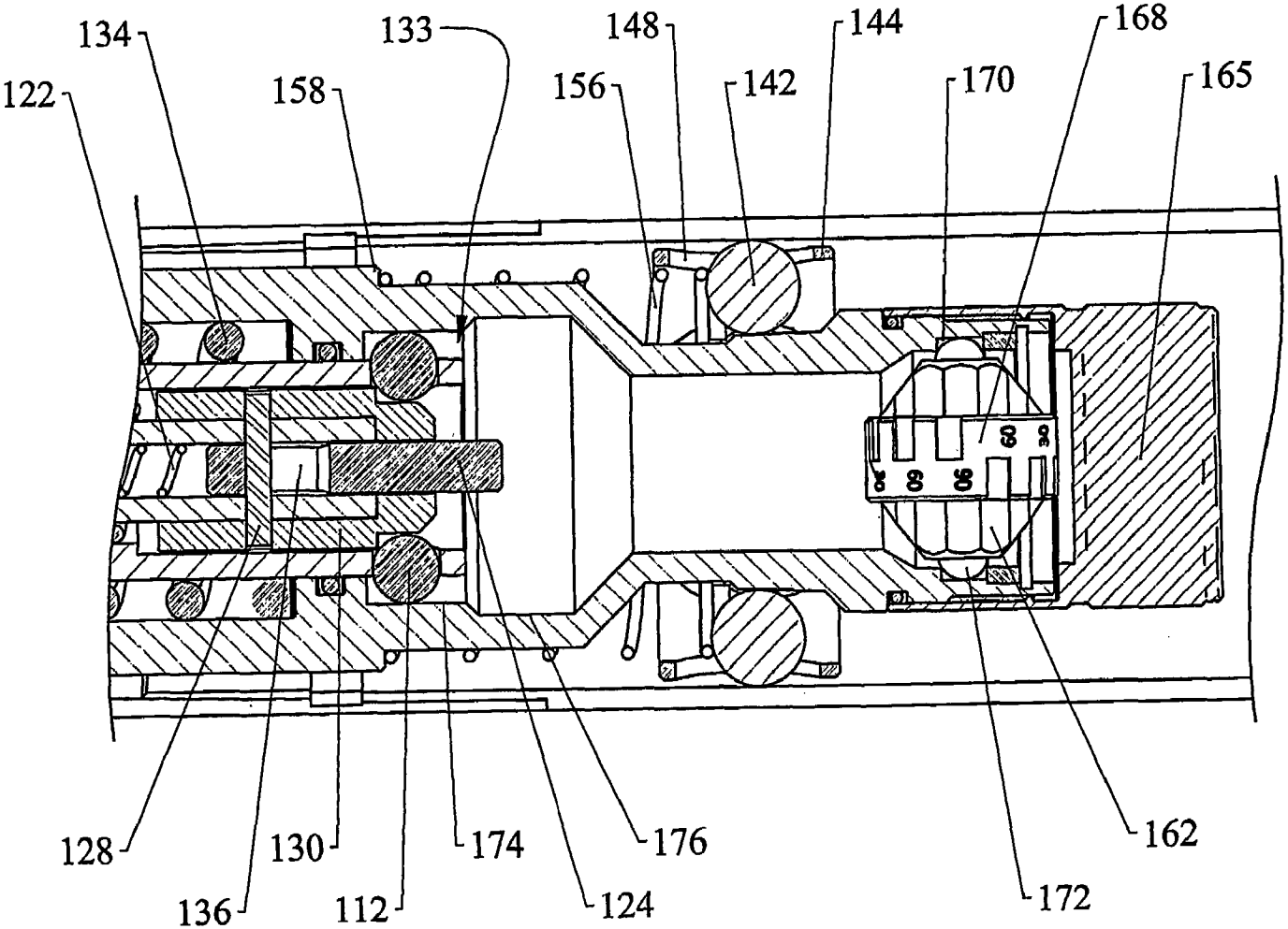
FIG. 6 is an enlarged view of one end of the orientation device.

Referring now to FIG. 5, it will be seen that as the core drill 24 is further lowered towards the toe of the hole, the extension 90 is pushed further into the body 12 against the bias of spring 134 to a position where the latching seat 114 is moved from underneath the latches 16 allowing them to rotate radially inwardly about respective pins 138. This radially inward movement is further facilitated by provision of complimentary tapered surfaces on the latches 16 and the lifter case 20.

With the latches 16 now disengaged from the core lifter case assembly 20, the further lowering of the core drill 24 into the bottom of the hole results in the entirety of the orientation device 10 sliding in an uphole direction within the core tube 22. The brake 18 does not prevent such motion as the anchor balls 142 are able to be simply rolled along the braking surface 150/or surfaces 154 and 152 to a position where they do not wedge against the inside surface of the core tube 22. This is further facilitated by virtue of the spring 156 not being able to resist the weight of the core drill 24.

Just prior to the core drill 24 touching the toe of the hole, a drill operator commences operation of the drill 24 causing it to rotate about its longitudinal axis. The core drill 24 can now cut a core sample of the ground. As the core sample is cut, it advances into the core drill 24 entering the core lifter case assembly 20 and core tube 22. This pushes the orientation device 10 further in the uphole direction within the core tube 22.

Once a length of core has been cut, the core drill 24 is stopped and lifted from the bottom of the hole. In this action, in the event that the core has not previously broken away from the ground from which it is cut, the core lifter case assembly 20 acts in a conventional manner gripping the core so that a tensile force can be applied to the core as the drill 24 is lifted from the ground thereby braking the core sample. The core tube 22 can then be retrieved in a conventional manner leaving the drill 24 in situ in the hole. The device 10 is retrieved with the core tube 22. The device 10 can then be removed from the core tube 22 together with the core sample. Since the face orientator 28 is disposed within the shroud 86, the configuration of the pins 32 is maintained and can then be matched against the face of the core sample. Further, the orientation balls 60 are clamped by action of the spring 132 providing indication of the position of the bottom of the hole. This then allows the orientation of the core sample to be uniquely defined. Further, the inclinometer 60 provides an indication of the inclination of the core sample cut from the ground. Particularly, the inclinometer reading may be taken by unscrewing a cap 165 inserting a sighting lens to the tail section 146 to view the scale 168.

From the above description it will be appreciated that embodiments of the present invention are able to overcome the aforementioned deficiencies in the prior art because the orientation of the core is effectively "marked" prior to commencement of drilling and thus there is no need for a positive core break to retain the core orientation information, or to trip a separate tool to obtain the hole inclination. The device 10 is simply tripped with the core tube 22 rather than requiring separate tripping.

The core block 34 can be removed by unscrewing the screw 48 so as to be held as a permanent record of core orientation with the core sample. To this end the outside of the core block or the core sample itself should be marked with a line in alignment with the balls 60. Further, in such an instance it is preferable if the core block 34 is made of a relatively cheap material such as plastics material.

Figure 7:
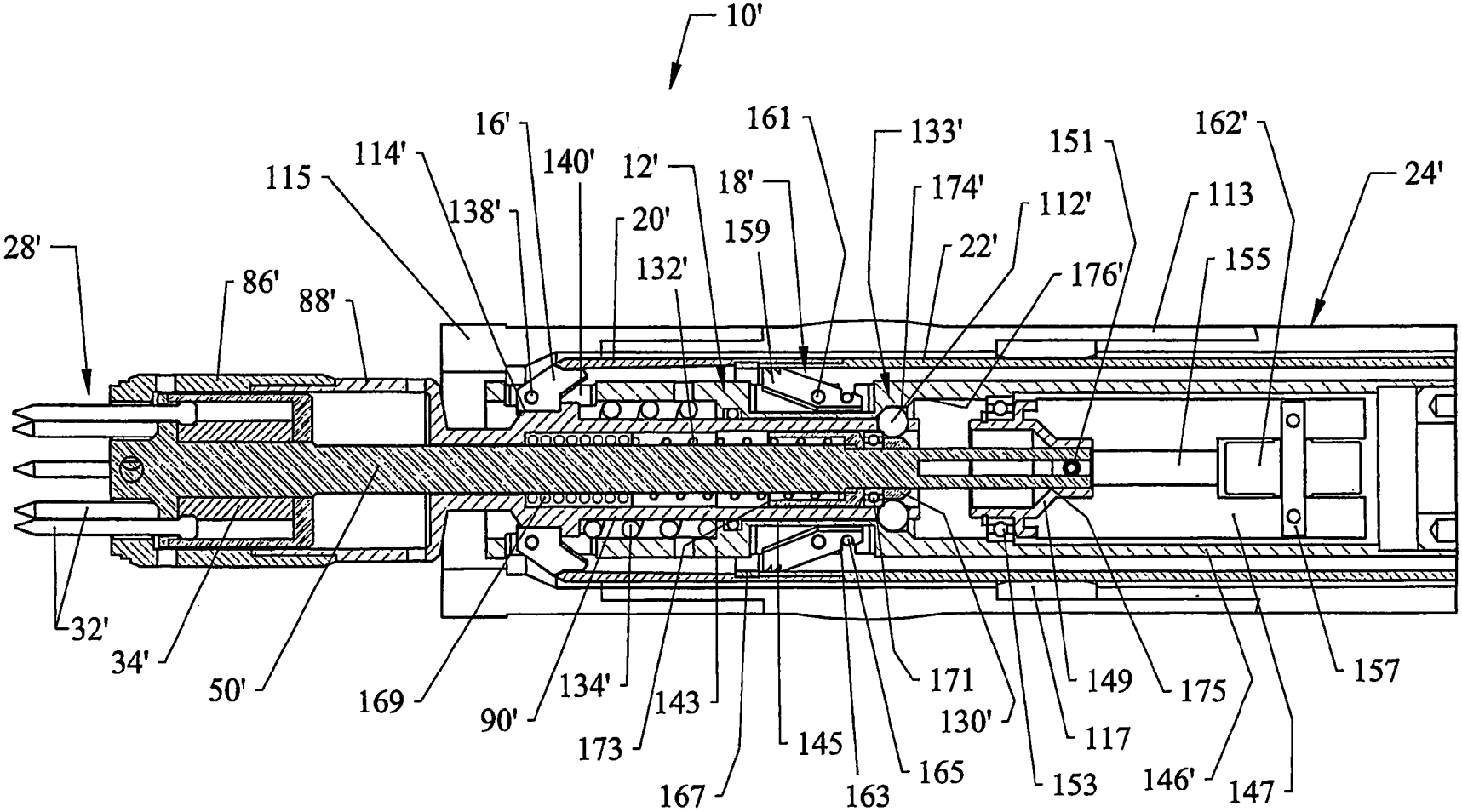
FIG. 7 is a section view of a second embodiment of the orientation device.
Figure 8:
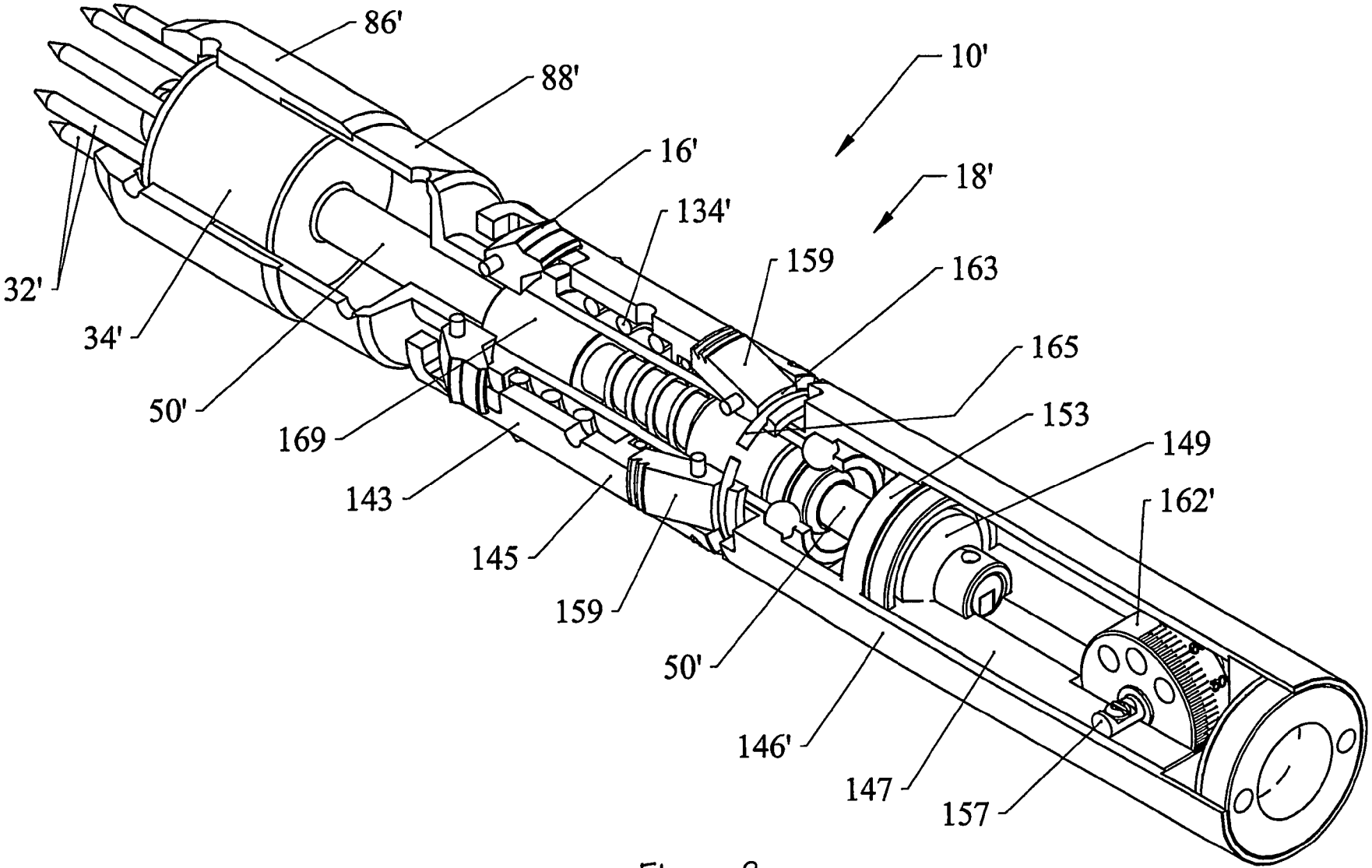
FIG. 8 is a partial cutaway perspective view of the orientation device shown in FIG. 7

A further embodiment of the core orientation device is depicted in FIGS. 7 and 8 in which features the same, similar or perform equivalent functions as in the embodiment depicted in FIGS. 1-6 are denoted by the same reference numbers but with the inclusion of a superscripted prime (') symbol. The core orientator 10' and core tube 22' are depicted within a core drill 24' includes at a downhole end a reamer 113 and core drill bit 115. A stabilising ring 117 is also depicted coupled between the drive within the core drill 24'. The core drill 24', reamer 113, drill bit 115 and stabilising ring 117 are of conventional construction and do not form part of the embodiment of the orientator 10'.

The main differences between the orientators 10 and 10' are summarised as follows. The body 12' has a forward section 143 housing the locking spring 134' and provided with windows 140' all of which are of substantially similar configuration to the corresponding portion of the body 12 of the first embodiment. The body portion 12' also includes a tail section 146' provided with the surfaces 174' and 176' which, together with the trigger balls 112' and trigger ball seat 130' form detent 133'. However, the forward section 143' and tail section 146' of the body 12' are spaced by an integral tubular section 145.

The tail section 146' houses a deadweight 147 which is attached to the shaft 50' by a coupling 149 and pin 151. The deadweight 147 and coupling 149 are able to rotate about the longitudinal axis of the shaft 50'. To this end, the coupling 149 is mounted in a bearing 153 having an outer race which is seated against an inner circumferential surface of the tail section 146'. The deadweight 147 is provided with a longitudinal slot 155 along which the shaft 50' can axially slide.

Inclinometer wheel 162' is attached via an axle 157 to the deadweight 147 at an end distant the face orientator 28'. Since the deadweight 147 can rotate about the longitudinal axis of the shaft 50' within the tail section 146', the inclinometer wheel 162' is in effect able to rotate about two perpendicular axes in a like manner as the wheel 162, these axes being the longitudinal axis of the shaft 50' and the axis of axle 157.

The second latches 18' in the orientator 10' are mounted about the intermediate section 145 of the body 12'. The latches 18 are in the form of pawls 159 which are pivotally coupled by pins 161 to the body 12'. Each pawl 159 is provided with a groove 163 on a radially outer surface for seating a spring 165. The spring 165 biases the pawls 159 radially outward about pins 161 to enable abutment against a stop ring 167 coupled between the core lifter case 20' and core tube 22'.

As mentioned above, the shaft 50' is able to rotate about its longitudinal axis in the orientator 10'. To assist in facilitating this rotational motion, the shaft 50' is supported by a linear bearing 169 housed within the tubular extension 90' of the locking housing 88', and a bearing 171 also housed within the extension 90' but spaced from the linear bearing 169 and adjacent the trigger ball seat 130'.

One end of the shaft spring 132' abuts the linear bearing 169. An opposite end of the spring 132' is seated within a cup-shaped member 173 which is attached to the shaft 50' adjacent the bearing 171. It will be further noted that the shaft 50' at an end opposite the face orientator 28' is formed with a bifurcation 175 through which the pin 151 extends.

When the device 10' and corresponding end of the core drill 24' lie in a non-vertical plane, the deadweight 147 will rotate about the longitudinal axis of the shaft 50' to a position where it possesses the least potential energy. That is, the deadweight 147 will position itself that it lies lower most within the body 12'. Since the shaft 50' is attached via the coupling 149 to the deadweight 147, shaft 50' and face orientator 28' are rotated with the deadweight 147'. It will be recognised that this functionality is equivalent to that provided by the bottom orientator 30 of the first embodiment.

The operation of the rotator 10' will now be described.

The device 10' is manipulated so that the shaft 50' is pulled to its maximum extent out of the shroud 86' with the pins 32' also pulled out to the maximum extent. In this configuration the trigger balls 112' are held between the trigger ball seat 130' and the surface 174' axially locking the shaft 50' to the shroud 86' and tubular extension 90'. The device 10 is then inserted rearwardly into the core of the case assembly 20. The pawls 159 are able to pivot inwardly about pins 161 against the bias of spring 165 past the stop ring 167. When in this position, the latches 16' engage the end of the core lifter case as depicted in FIG. 7.

With the core drill 24' already in the hole, the core lifter tube 22 is then lowered through the core drill 24' in a conventional manner. The drill 24' is held above the toe of the hole at sufficient distance so that when the core tube 20 is properly located within the drill 24', the elements 28' are spaced from the toe of the hole. An operator then lowers the drill 24' to the toe of the hole. During the travel of the device 10' and core tube 22' through the drill 24', the counterweight 147 will have rotated within the tail section 146' to the lowest point within the housing 12' by action of gravity. This in turn will have rotated the shaft 50' and face orientator 28' to provide a bottom reference for the face orientator 28' and subsequent core cut by the drill 24'.

As the drill 24' is lowered onto the facing surface of the toe of the hole, the pins 28' contact the facing surface and are pushed inwardly into the bush 34' to provide profile reference points conforming to the configuration of the face of a core sample to be cut. The pins 28' are maintained in their position by virtue of frictional force existing between the pins 28' and the core block 34'.

As the drill 24' advances towards the toe of the hole, eventually the forward axial face of the shroud 86' contacts the facing surface of the hole. Now the weight of the drill 24' is loaded onto the shroud 86'. This causes the shroud 86' to move axially toward the body 12' with the extension 90' projecting further into the body 12'. As a result the trigger balls 112' eventually roll onto the increased diameter portion 176' of the tail section 146' axially releasing the shaft 50' from the extension 90'. This releases the spring 132' which drives the shaft 50' further in an uphole direction into the body 12' so as to eventually contact the inclinometer wheel 162' preventing it from further rotation about the axle 157 to thus provide an indication of the inclination of the device 10' at a time commensurate with the commencement of cutting of the core.

Eventually, the shroud 86' is pushed to a position where the latching surfaces 114' are slid away from beneath the latches 16' allowing the latches to collapse or pivot inwardly thereby becoming disengaged from the core lifter case assembly 20'. Further lowering of the drill 24' onto the bottom of the hole results in the entirety of the device 10' sliding in an uphole direction within the core tube 22'.

The drill 24' is then operated in a conventional manner to cut a core. As the core is being cut, it enters the core tube 22' pushing the device 10' further in the uphole direction.

Once a length of core has been cut, the drill 24' is stopped and lifted from the bottom of the hole. In this action, in the event that the core is not previously broken away from the ground, the lifter case assembly 20' grips the core and a tensile force applied by the lifting of the drill 24' breaks the core from the ground. The core tube 22' is then retrieved in a conventional manner leaving the drill 111 in situ. The device 10' is retrieved with the core tube 22'. The device 10' is then removed from the core tube 22' together with the core sample. As the deadweight 147 always self-locates to the lowest position within the body 12', by aligning the face of the core with the pins 28', the orientation of the core within the ground can be determined. Further, the inclination of the core sample can be determined by viewing the inclinometer wheel 162'.

Prior to cutting the next length, the device 10' is simply reloaded into the core tube 22' and the resulting ensemble then lowered through the drill 24' in a conventional manner and the sequence recommenced.

Figure 9:
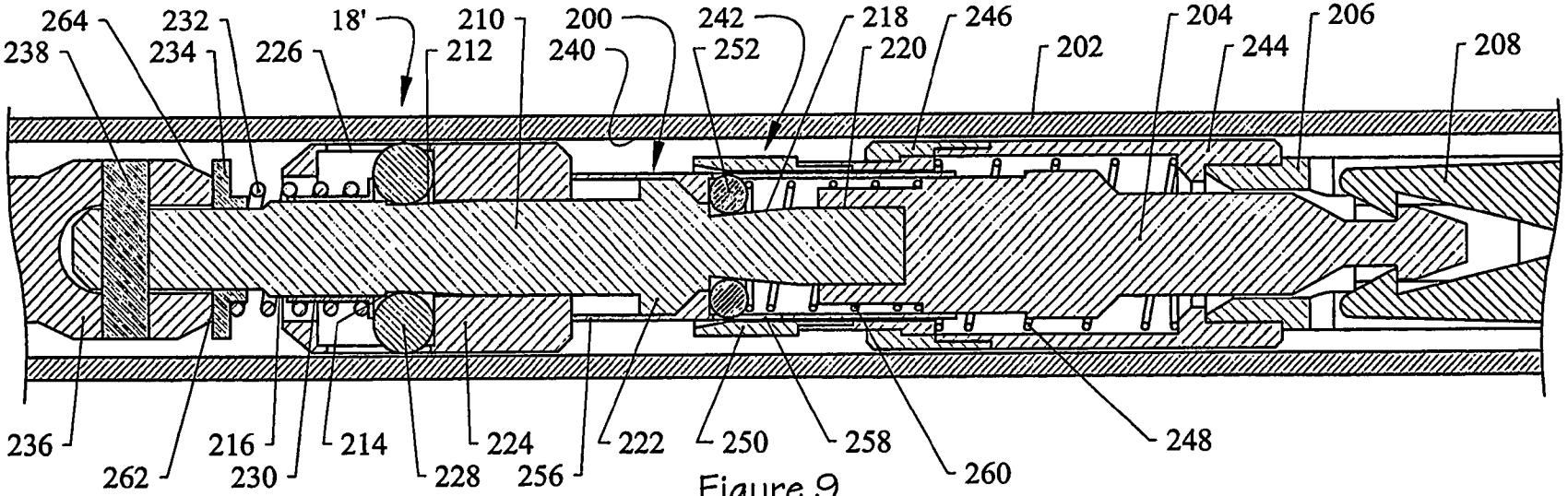
FIG. 9 is a section view of a modified form of brake system incorporated in the orientation device but applied to a running tool, with the brake system in a release position; and, FIG. 10 is a section view of the brake system depicted in FIG. 9 in an applied state.
Figure 10:
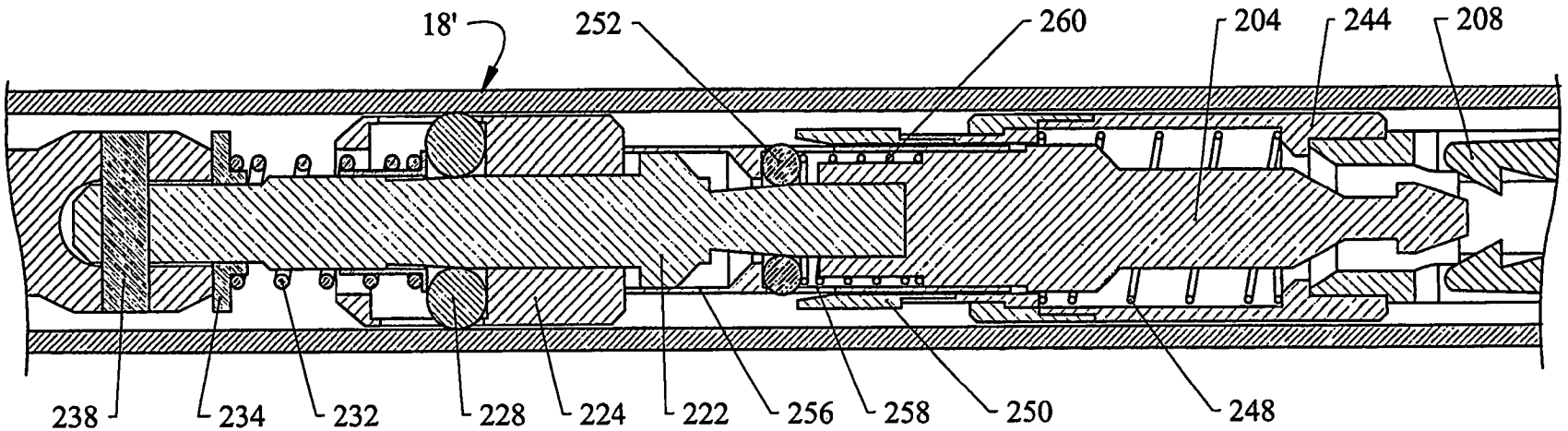

The braking system 18 used in the device 10 can be used in other applications and in particular to prevent loss of running tools and other downhole equipment in the event of failure or accidental release from an overshot and/or wireline. In addition, as previously mentioned, the braking system also assists in reducing the speed of a running tool when returning under the action of gravity within drill string or drill pipe in an uphole orientation. Moreover, as depicted in FIGS. 9 and 10, the braking system 18 can be incorporated into a head assembly 200 of any form of running tool or downhole device to hold the tool or device within a drill pipe 202. The head assembly 200 includes a conventional spearpoint 204 which is adapted for coupling to a conventional overshot 206 provided with overshot latch dogs 208. The interaction and operation of the spearpoint 204 and overshot 206 is well known to those skilled in the art and not described in any detail herein.

The head assembly 200 includes a shaft 210 which is fixed to the spearpoint 204. The shaft 210 is provided along a portion of the length of its outer circumferential surface with a braking surface 212 which is tapered so as to gradually increase in outer diameter in a direction toward a mouth of a hole into which the drill pipe 202 is disposed. Braking surface 212 terminates in a downhole side in a radially outward step 214 leading to a constant diameter portion 216 of the shaft 210.

A further tapered surface 218 is provided on the shaft 210 and tapers in the same direction to the locking surface 212 so as to increase in outer diameter in an uphole direction. The tapered surface 218 leads to a constant diameter portion 220 which engages with the spearpoint 204. The shaft 210 is provided with an enlarged portion 222 between the surfaces 212 and 218.

An anchor ball sleeve 224 is slidably retained about the shaft 210 over the braking surface 212. The sleeve 224 is provided with a plurality of slots 226 through which anchor balls 228 can extend. The anchor balls 228 are located to ride along the braking surface 212, the slots 226 formed of a width less than the diameter of the anchor balls 228. A bush 230 is located about the surface portion 216 of the shaft 210 that acts as a seat for a spring 232. The spring 232 is further retained by a detente washer 234 which sits on a spearhead base 236 which is coupled via a pivot pin 238 to the downhole end of the shaft 210. The spring 232 biases the anchor balls 228 to ride along the braking surface 212 to extend from the slots 226 to wedge against inner circumferential surface 240 of the drill pipe 202.

The braking system 18 also includes an automatically releasable brake lock 242 which acts to ordinarily hold the anchor balls 228 out of contact with the inner surface 240 to allow free running of an associated tool within the drill pipe 202 when attached to a overshot 206, but automatically deploys of the anchor bolts 228 to lock or brake the tool within the drill pipe 202 when the overshot 208 is released from the spearpoint 204.

The automatically releasable brake lock 242 includes an overshot extension sleeve 244, a cap 246, spring 248, locking sleeve 250, balls 252 and floating sleeve 256. The overshot extension sleeve 244 is threadingly coupled at one end to the overshot 206. The cap 246 is threadingly coupled to an opposite end of the extension sleeve 244. The cap 246 further slidably engages the locking sleeve 250, with the spring 248 being disposed about the spearpoint 204 between the end of the extension sleeve 244 coupled to the overshot 206 and the locking sleeve 250. The locking sleeve 250 is dimensioned so that it can extend over the balls 252. The balls 252 are retained about the surface 218 by the floating sleeve 256 which is provided with apertures 258 through which the balls 252 can extend. A further spring 260 is located within the floating sleeve 256 and acts between the spearpoint 204 and the balls 252 urging the balls 252 to roll to an end of the surface 228 with the smallest outer diameter.

The spearhead base 236 is provided with a planar end surface 262 from which extends an outwardly tapered surface 264 extending at an angle of 45° relative to the surface 262.

When the overshot latch dogs 208 are engaged with the spearpoint 204, the spring 248 urges the locking sleeve 250 over the balls 252 preventing them extending radially outwardly from the apertures 258. In addition, the floating sleeve 256 is forced in a downhole direction bearing against the anchor ball sleeve 224 forcing the anchor balls 228 against the step 214 and thus disposed about a portion of the surface 212 with the smallest outer diameter allowing the balls 228 to be spaced from the surface 240. In this configuration, the tool to which the braking system 18' is attached is able to run freely in any direction within the drive pipe 202.

However, if the latch dogs 208 become detached from the spearpoint 204 while within the drill pipe 202, the brake lock 242 is automatically released deploying of the anchor balls 228. This arises as follows. With the disengagement of the latch dogs 208, the extension sleeve 244 which is attached to the overshot 206 holds the locking sleeve 250 as the spearpoint 204 and remainder of the assembly 200 starts to fall dragging the locking sleeve 250 with it. Thus in effect the locking sleeve 250 is pulled away from the balls 252. The balls 252 are now free to move radially outwardly as they roll along the surface 218 toward the spearpoint 204 by action of the spring 232. In this regard, the spring 232 urges the anchor ball sleeve 242 and thus the floating sleeve 256 toward the spearpoint 204. With the locking sleeve 250 retracted, the floating sleeve 256 can then roll the balls along the surface 218 against the bias of the spring 260. Simultaneously, the spring 232 urges the anchor balls 228 to roll along the braking surface 212 which, due to its increasing outer diameter results in the balls 228 extending from the holes 226 and into contact with the surface 240.

Assuming for the time being that the drill pipe 202 is disposed in a downhole (as distinct from an uphole) the weight of the tool to which the braking system 18' is attached together with the action of the spring 232 will effectively wedge the anchor balls 228 between the surfaces 212 and 240 to lock the tool to the drill pipe 202. Now, a fresh overshot 208 can be lowered into the hole to engage the spearpoint 204. As the overshot is now retrieved by a wireline, it pulls the spearpoint 204 and shaft 210 in an uphole direction causing it to slide relative to the anchor ball sleeve 224. As this occurs, the balls 228 are able to roll along the braking surface 212 toward the step 214 thereby releasing the balls 228 from engagement with the surface 240. Simultaneously, the floating sleeve 256 and locking sleeve 250 are caused to slide relative to the shaft 210 back to the configuration depicted in FIG. 7 so that the balls 252 effectively lock the anchor balls 228 from engagement with the surface 250.

In the event of an uphole application, the spring 232 can be provided with an appropriate spring constant so as to urge the balls 228 into engagement with the surface 240 to provide a braking effect as distinct from wedging against the surface 240 to lock an associated tool into the drill pipe 202. This difference in operation is due to the fact that gravity now acts in a direction which tends to roll the balls 228 along the braking surface 212 toward the step 214 where the balls are out of engagement with the surface 210.

This then provides a manner for controlling the rate of descent of a tool in an uphole disposed drill pipe, which would otherwise free fall and smash against the head of the drill pipe.

Now that embodiments of the present invention have been described in detail it will be apparent to those skilled in the relevant arts that numerous modifications and variations may be made without departing from the basic inventive concepts. For example, the face orientator 28,28' is depicted as a VAN RUTH style orientator. However this may be replaced by other marking systems including, for example, a pad of malleable material which can take an impression of the facing surface of the toe of the hole, or even simply a marker which can mark the core such as a China graph pencil. Further, a combination of pins 32 and markers may be used extending from the same core block 34.

In addition, if desired, a core tube extension can be coupled between the core tube 22,22' and a conventional back end for the purposes of receiving the device 10,10' during a core run. The extension is in the form of a tube of the same length as the device 10,10' and may be provided with an internal shoulder or stop to provide an abutment surface for a portion of the shroud 86 or housing 88 located at a position so that when the abutment engages the shroud 86 or housing 88 the entirety of the device 10' is located within the core tube extension. This ensures that the core tube 22 is left entirely for receipt of the core being cut and also provides protection of the device 10,10' in the event of over drilling of the core. In this instance, the core would abut against the face of the shroud 86 which is made of thickened material. Further, due to the abutment of the shroud 86 and/or housing 88 with the core extension tube, any load applied by over drilling of the core would essentially be borne on the shroud 86/housing 88 and core extension tube, rather than being transmitted to the remainder of the device 10,10'.

All such variations and modifications are deemed to be within the scope of the present invention the nature of which is to be determined from the above description and the appended claims.

The invention claimed is:

1. An orientation device for providing an indication of the orientation of a core sample of material relative to a body of material from which the core is cut, said orientation device comprising:

a main body including a latching system to releasably latch the orientation device to a core lifter case assembly coupled to a core tube of a core drill used to cut said core sample;

a shroud slidably coupled to the main body; and, a core orientation device slidably coupled to said shroud and said main body;

wherein the core orientation device provides one or more orientation references for said core sample by contacting a facing surface of said material to be drilled by said core drill prior to commencement of drilling, and said shroud is operatively associated with said latching system such that, upon sliding of said shroud toward said main body beyond a trigger point facilitated by advancing said core drill onto said facing surface, said latching system disengages from said core lifter case assembly so that said orientation device is retracted into said core tube by an advancing core when said drill is operated to cut said core.

2. The orientation device according to claim 1, wherein said latching system comprises a first latch to engage said core lifter case assembly so as to prevent said main body from moving in a direction away from said core prior to said shroud reaching said trigger point.

3. The orientation device according to claim 2, wherein said latching system further comprises a second latch to engage said core tube so as to prevent motion of said main body in a direction toward said core.

4. The orientation device according to claim 3, wherein said second latch comprises a brake mechanism supported by said main body and including a plurality of brake elements which, when said main body is moved in a direction toward said core relative to said core tube, wedge between said main body and an inner surface of said core tube with increasing force to brake relative motion of said main body with respect to said core and effectively releasably lock said main body to said core tube, and when said main body is moved in a direction away from said core relative to said core tube, said brake elements self release from said inside surface of said core tube.

5. The orientation device according to claim 4, wherein said braking mechanism comprises a braking surface formed about said main body, said braking surface being provided with a progressively increasing outer diameter in said direction away from said core, and a brake bias device to bias said brake elements in said direction away from said core along said braking surface.

6. The orientation device according to claim 5, wherein said braking mechanism further comprises a retainer to retain said braking elements about said main body.

7. The orientation device according to claim 4, wherein each of said braking elements is in the form of a ball.

8. The orientation device according to claim 1, wherein said core orientation device includes a face orientator including one or more orientation elements that provide said one or more orientation references and wherein said one or more orientation elements retract into said shroud as said core drill is advanced onto said facing surface.

9. The orientation device according to claim 8, further comprising a tubular extension coupled to said shroud and extending into and slidably retained by said main body, wherein said tubular extension includes a latching surface, said latching system comprises a first latch that is held in engagement with said core lifter case assembly by abutment of said first latch with said latching surface such that, as said core drill is advanced onto said facing surface, said shroud contacts said facing surface and slides toward said main body to move said latching surface out of abutment with said first latching means thereby disengaging said first latch from said core lifter case assembly to facilitate retraction of said orientation device into said core tube.

10. The orientation device according to claim 9, wherein said core orientation device further comprises a shaft that extends through said tubular extension and housing into said shroud and includes an end located inside said shroud at which said one or more orientation elements are supported.

11. The orientation device according to claim 10, further comprising a first bias device to bias said tubular extension in a direction toward said core and said latching surface into abutment with said first latch.

12. The orientation device according to claim 11, further comprising a detent to releasably axially lock said shaft to said tubular extension and a second bias device acting between said shaft and said tubular extension, wherein the second bias device biases said shaft to move axially in said direction away from said core relative to said tubular extension when said detent is released.

13. The orientation device according to claim 12, wherein said detent acts between said main body and said tubular extension and is released as said shroud slides toward said main body prior to reaching said trigger point.

14. The orientation device according to claim 13, wherein said shroud and said one or more orientation elements are relatively dimensioned so that, when said detent is released, said shaft moves axially in said direction away from said core by a distance sufficient so that said orientation elements are wholly located within said shroud.

15. The orientation device according to claim 1, wherein said core orientation device further comprises a bottom orientator including a plurality of orientation balls and a plurality of races about which individual orientation balls can run, each race being formed by two opposing race surfaces which are adapted to move relative to each other between a free run position, where said race surfaces are spaced sufficiently apart to allow an orientation ball therebetween to run freely, and a clamp position, where two adjacent race surfaces clamp an orientation ball therebetween to prevent said orientation ball from free running about said race.

16. The orientation device according to claim 15, further comprising a shaft extending from said main body into said shroud, a detent releasably axially locking said shaft relative to said shroud and a bias device to bias said shaft to move in a direction away from the core relative to the shroud when said detent is released, wherein said race surfaces are moved between said free run position and said clamp position by said bias device upon release of said detent.

17. The orientation device according to claim 15, wherein one or more of said race surfaces are formed of a material which is sufficiently soft so that when said race surfaces are in said clamp position an orientation ball therebetween indents said race surfaces.

18. The orientation device according to claim 15, further comprising a shaft extending from said main body and into said shroud, wherein said races include at least one annular disc slidably mounted on said shaft.

19. The orientation device according to claim 15, further comprising a shaft extending from said main body and into said shroud, wherein said bottom orientator comprises three orientation balls and said races comprise two annular discs slidably mounted on said shaft and respective first end and second end race surfaces supported on said shaft between which said two annular discs are located, wherein said second end race surface is fixed to a downhole side of said shaft and said first end race surface is slidably mounted on said shaft.

20. The orientation device according to claim 1, further comprising an inclinometer disposed within said main body to provide an indication of inclination of said orientation device when said shroud is in contact with said facing surface.

21. The orientation device according to claim 20, wherein said inclinometer is in the form of a rotatable wheel, and said shaft is moved toward said wheel to prevent rotation thereof when said detent is released.

22. The orientation device according to claim 21, wherein said wheel is mounted to rotate about first and second mutually perpendicular axes.

23. The orientation device according to claim 22, wherein said wheel is provided with a pair of ball bearings on opposite sides of an axis of said wheel and said inclinometer further includes a circular race within which said ball bearings run, said circular race having an axis coincident with a longitudinal axis of said main body.

24. The orientation device according to claim 10, wherein said shaft is rotatably held within said tubular extension to facilitate rotation of said shaft about its longitudinal axis relative to said shroud.

25. The orientation device according to claim 24, further comprising a deadweight disposed in said main body and coupled to said shaft to rotate said shaft about its longitudinal axis by action of gravity so as to provide a bottom of hole reference.

26. The orientation device according to claim 24, further comprising an inclinometer disposed within said main body to provide an indication of inclination of said orientation device when said shroud is in contact with said facing surface.

27. The orientation device according to claim 26, wherein said inclinometer is in the form of a rotatable wheels, and said shaft is moved toward said wheel to prevent rotation thereof when said detent means is released.

28. The orientation device according to claim 27, wherein said wheel is mounted to rotate about first and second mutually perpendicular axes.

29. The orientation device according to claim 23, wherein said second latch comprises two or more pawls pivotally coupled to said main body and biased into contact with an inner surface of said core lifter case assembly.

* * * * *